United States Patent [19]

Mattioli

[11] Patent Number: 4,735,035

[45] Date of Patent: Apr. 5, 1988

[54] LEAD ROPE

[76] Inventor: Peter P. Mattioli, 603 Hunter La., Santa Rosa, Calif. 95404

[21] Appl. No.: 17,526

[22] Filed: Feb. 24, 1987

[51] Int. Cl.[4] ..... B68B 1/00

[52] U.S. Cl. ..... 54/34; 119/109; 272/75; 57/230; 87/11

[58] Field of Search ..... 272/75; 57/225, 230; 280/480; 54/34, 16, 36, 64; 119/109; 231/2 R; 87/11

[56] References Cited

U.S. PATENT DOCUMENTS

| | | | |
|---|---|---|---|
| 54,729 | 5/1866 | Howe | 54/34 |
| 153,724 | 8/1874 | Schmidt | 54/34 |
| 3,415,515 | 12/1968 | Otto | 272/75 |
| 4,258,608 | 3/1981 | Brown | 87/11 X |
| 4,470,250 | 9/1984 | Arenz et al. | 57/230 |
| 4,522,153 | 6/1985 | Vander Horst | 119/109 |

*Primary Examiner*—Robert P. Swiatek
*Assistant Examiner*—Mary McNeil
*Attorney, Agent, or Firm*—Melvin R. Stidham

[57] ABSTRACT

A lead line for a large animal comprises a length of rope made up of a tubular sheath of a woven fabric with an inner core of a soft fibrous material. At the outer end of the rope the soft inner core has been removed and replaced by a rigid rod so that the head of the animal can be pushed and held at arm's length.

3 Claims, 1 Drawing Sheet

LEAD ROPE

BACKGROUND OF THE INVENTION

Large manageable animals, such as horses, cows and sheep are generally moved from place to place through short distances by walking them, pulling or leading them on a simple lead rope attached to a bridle, a collar or the like. Such lead ropes are quite satisfactory in most instances, but some problems often arise to compound the difficulty of handling an animal with nothing more than the lead rope. For example, a horse that becomes nervous or over zealous often nudges or crowds its handler so that the handler is forced to push the horses head away with his elbow while pulling the lead rope with his hand.

Some restraining devices have been applied to halters or tethering ropes, i.e. when the animal is tied up. For example, Howe, U.S. Pat. No. 54,729 shows a halter on which a plurality of small cylinders are strung in the nature of beads to prevent the rope from being coiled about the legs of the animal, thereby reducing the chance of injury. Warne, et al U.S. Pat. No. 67,689 shows a halter comprising a rigid bar with straps on the ends to attach to the bridle of the horse and the hitching posts. Brubaker U.S. Pat. No. 136,811 shows a steel rod having loops at the opposite ends through which a strap may be strung to hitch a horse to a tree or a post while preventing him from rubbing against it. Because of the continuous strap, the horse is not freed by accidental breakage of the steel rod.

OBJECTS OF THE INVENTION

It is an object of this invention to provide a lead rope wherein a horse or other animal may be led by pulling while being held at a distance.

It is a further object of this invention to provide a lead rope for a horse that prevents the horse from nuzzling or crowding its handler.

Other objects and advantages of this invention will become apparent from the description to follow, particularly when read in conjunction with the accompanying drawing.

SUMMARY OF THIS INVENTION

In carrying out this invention I provide a lead rope, preferably about ⅝ inches in diameter and about 8 to 10 feet in length. A metal clip is carried at one end of the rope for securing the rope to a bridle and the 8 to 10 foot length provides ample room for gripping the rope for gently pulling the animal. In the length of rope adjacent the bridle clip, there is embedded a stiff rod of plastic or metal, 15 to 20 inches in length, enabling the handler to use the end of the lead rope as a push rod to hold the head of the animal at arm's length.

DESCRIPTION OF A PREFERRED EMBODIMENT

Figures 1, 2:
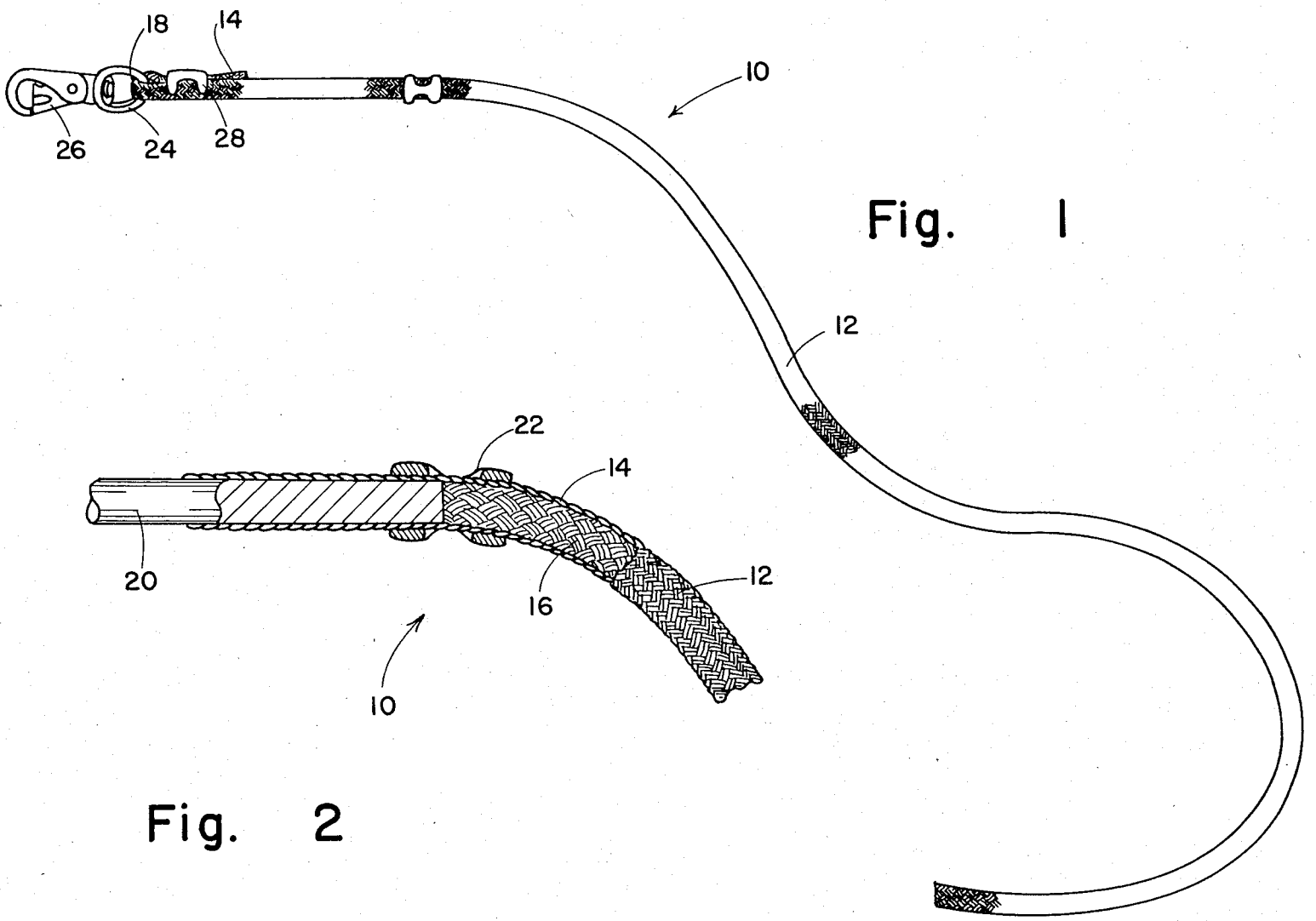
FIG. 1 is a view in perspective showing the lead rope of this invention.
FIG. 2 is an enlarged view in perspective of a segment of the lead rope, partially broken away to show interior structure.

Referrring now to the drawing with greater particularity, the lead rope 10 of this invention comprises essentially a flexible rope 12 of suitable fabric fibers, such as nylon, about ⅝ inches in diameter and 8 to 10 feet in length. Rope of this type 12 is commercially available and has a woven nylon, tubular sheath 14 of woven nylon fibers or the like, and a central core 16 of loosely braided nylon fibers.

Adjacent one end 18 of the rope 10, an approximately two feet length of the braided core 16 is removed and a relatively stiff rod 20 of Fiberglas, aluminum or other suitable material approximately one and one-half feet in length is inserted. The rod 20 is secured in place by a suitable clamp device 22 that is constricted around the rope 12 and around the rope covered rod 20. Then the rope sheath 14 beyond the rod 20 is inserted through the loop or attachment ring 24 of a bridle clip 26 and folded on itself. The lapped end is clamped in place on the rod 20 by gripping it with another clamp 28. To prevent raveling, the ends of the rope sheath 14 may be heated to melt the plastic fibers, causing them to run together.

When assembled, the rope provides an ample length of limp, unsupported nylon rope 12 for pulling a horse, cattle, sheep or the like by attachment to a bridle or other device on the animal's head. The rigid section wherein the rigid bar 20 is embedded may be used as a push member to hold the animal at arm's length and prevent it from nuzzling or otherwise interfering with the free operation of the handler.

While this invention has been described in conjunction with a preferred embodiment thereof, it is obvious that modifications and changes therein may be made by those skilled in the art to which it pertains without departing from the spirit and scope of this invention, as defined by the claims appended hereto.

What is claimed as invention is:

1. A lead line for handling a large animal comprising:
an elongated, flexible rope of braided fibers;
a clip for attachment to a bridle or the like secured at one end of said rope; and
a rigid rod embedded in said rope adjacent said one end;
said rope comprising a tubular sheath of a woven fabric and over most of its length a flexible inner core of a fibrous material;
said core being removed adjacent said one end only and replaced by said rigid rod.

2. The lead line defined by claim 1 wherein:
said rope comprises a tubular sheath of a woven fabric and an inner core of a fibrous material;
said core being removed adjacent said one end and replaced by said rigid rod.

3. The lead line defined by claim 1 including:
an attachment ring carried on said clip;
said one end of said rope outward of said rigid rod being looped through said ring and overlapping said rope and the rigid rod therein, and
clamp means gripping around opposite ends of the portion of said rope with the rigid rod therein.

* * * * *